United States Patent [19]

Drogo

[11] Patent Number: 4,506,943

[45] Date of Patent: Mar. 26, 1985

[54] ELECTRIC CONNECTOR

[76] Inventor: Pierre L. M. Drogo, 104, rue Garibaldi, Saint Maur (Val de Marne), France

[21] Appl. No.: 518,424

[22] Filed: Jul. 29, 1983

[30] Foreign Application Priority Data

Feb. 18, 1983 [FR] France ..... 83 02696
Jul. 11, 1983 [FR] France ..... 83 11513

[51] Int. Cl.[3] ..... H01R 13/625
[52] U.S. Cl. ..... 339/90 R; 339/DIG. 2
[58] Field of Search ..... 285/82, 86, 87, 88; 339/90 R, 90 C, 89 R, 89 C, 89 M, DIG. 2

[56] References Cited

U.S. PATENT DOCUMENTS 3,351,886 11/1967 Zimmerman, Jr. ..... 339/DIG. 2
3,552,777 1/1971 Heinrich et al. ..... 339/89 R

*Primary Examiner*—John McQuade

*Attorney, Agent, or Firm*—Louis Orenbuch

[57] ABSTRACT

An improved mechanism for drawing the two cylindrical parts of a multi-contact electrical connector together and holding them locked in position employs three rings stacked around one of the two cylindrical parts. In one embodiment, the middle ring is able to rotate and the two outer rings are non-rotatably attached to the cylindrical part on which the rings are mounted. A barrel surrounds the three rings and is arranged to rotate with the middle ring. The barrel has a collar that engages the other cylindrical part of the connector to initially hold the two parts together. The three rings, on their facing surfaces, have sloping cams. The sloping cams are arranged, upon rotation of the middle ring, to cause the middle ring and one of the outer rings to move apart while simultaneously causing the middle ring and the other outer ring to come closer together so that the total height of the three rings remains substantially unchanged.

21 Claims, 11 Drawing Figures

ELECTRIC CONNECTOR

The invention relates to an electric connector.

Conventional electric connectors comprise a plug and a jack each comprising a metal body holding an insert of insulating material that retains the pins and sockets which provide the electrical connections.

Either the plug or the jack have ribs which engage complementary grooves in the other member so as to obtain a foolproof connection, i.e. so that the plug can be coaxially fitted to the jack in only one angular position, in which each pin is disposed opposite its corresponding socket.

In these connectors, the plug is secured to the jack by a lock, which is secured to the plug by screw threads and is secured to the jack by a bayonet fitting, so that when the lock is secured to the socket by the bayonet device, the lock can be rotated to axially move the plug along the screw thread and bring it near the jack, so as to insert the pins into the connector sockets.

However, conventional connectors have a number of disadvantages, inter alia the following:

Conventional connectors are large in the axial and the radial directions because of the size which the components need in order to have sufficient mechanical strength and to be normally machined, and also because of the required height of the threading for securing the lock on the plug and the required height of the complementary ribs and grooves for foolproof securing of the plug to the jack.

In addition, ideally-constructed connectors have to simultaneously meet the following three conditions: light-weight, high reliability, and high-speed connection and disconnection.

To reduce the weight of the connector, the plug, jack and lock must be made of light metal, e.g. an aluminium alloy, but virtually all commercially available suitable light metals have poor durability, e.g. low resistance to wear by friction, and this reduces their reliability particularly in view of the wear on the thread for securing the lock on the plug.

Furthermore, if the connector has to be quickly connected, the inclination of the threading for securing the lock to the plug must be increased, and this further increases the friction and consequently the wear, particularly since the force required for connecting or disconnecting is relatively large and increases with the number of pins and connecting sockets.

This low reliability or low resistance to wear is particularly noticeable when the lock and plug are secured together by studs fitting in threaded grooves, since in that case the studs are made of hard metal, e.g. steel, to obtain mechanical strength, which results in rapid wear of the threaded sides.

The invention aims inter alia to obviate these disadvantages and to that end relates to an electric connector comprising a plug and a jack which can be axially connected by action of a lock on the plug, the plug and jack each comprising a member internally receiving an insert of insulating material formed with pins or sockets for making electrical connections, the lock being secured on the plug by means permitting controlled relative motion thereof in the axial direction and in rotation, the lock also comprising means for securing it to the jack and enabling the lock to rotate relative to the jack when in the connected position, the connector being characterised in that the means enabling the lock to move axially and in rotation relative to the plug comprise three coaxial rings disposed between the lock and plug with one of the rings being an intermediate ring disposed between two outer rings, the intermediate ring or the outer rings being prevented from rotating relative to the lock whereas the other ring or rings are prevented from rotating relative to the plug, the three rings each having at least one cam surface formed on the facing ends of the rings to co-operate with one another.

According to another feature of the invention, the rings are components independent of the lock and the plug.

According to another feature, the rings are prevented by complementary ribs and grooves from rotating relative to the lock or the plug.

According to another feature, the outer rings and the middle ring are axially held on the plug between a collar secured to the plug and a movable retaining means, with the interposition of at least one resiliently compressible means.

According to another feature, complementary detent catches and recesses are formed on the cam slopes of the facing ends of the rings.

According to another feature, the cam slopes have a number of longitudinally spaced catches adapted to co-operate successively with at least one recess formed on the facing cam slope.

The invention is shown by way of non-limitative examples in the accompanying drawings, in which.

Figure 1:
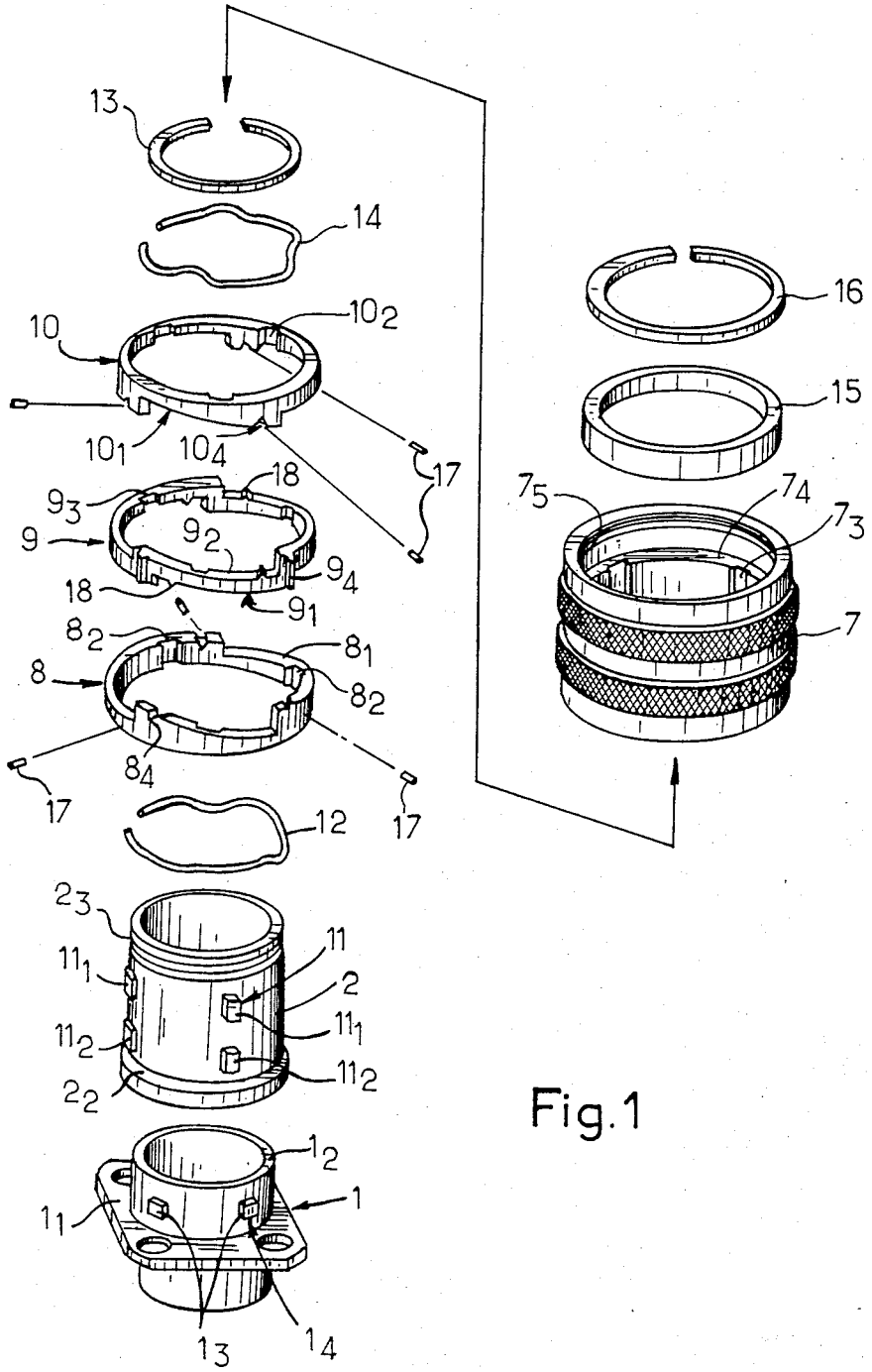
FIG. 1 is an exploded view of an embodiment of a connector according to the invention.

The object of the invention is to provide an electric connector which is quickly connected, has little bulk, low weight, and high reliability and resistance to wear.

The connector comprises a jack 1 and a plug 2 which internally receives an insert 3, 4 of insulating material, the inserts containing a number of pins 5 and sockets 6 for making electrical connections.

In the illustrated example, jack 1 has a flange $\mathbf{1}_1$ perforated for receiving screws for securing the jack to a support.

The jack is adapted to be secured by its end $\mathbf{1}_2$ inside the plug 2 and accordingly has external studs $\mathbf{1}_3$ or longitudinal ribs adapted to fit in corresponding grooves $\mathbf{2}_1$ (FIG. 2) in plug 2.

The complementary ribs and grooves are constructed so that the plug can be fitted to the jack in only one angular position, in which each pin 5 is placed along the axis of the corresponding socket 6.

This feature ensures foolproof securing of the plug on the connector.

A barrel 7 of the lock is mounted around plug 2 and is adapted to engage studs $1_3$ in the jack and then rotate so as to bring the plug towards the jack in order to engage the pins 5 inside the sockets 6.

In order to secure barrel 7 to studs $1_3$ of socket 1, barrel 7 at its base has an internal collar $7_1$ formed with grooves or slots $7_2$ complementary with the studs $1_3$ in socket 1.

Grooves $7_2$ accordingly correspond in shape and dimensions to the grooves $2_1$ of member 2.

Figure 4:
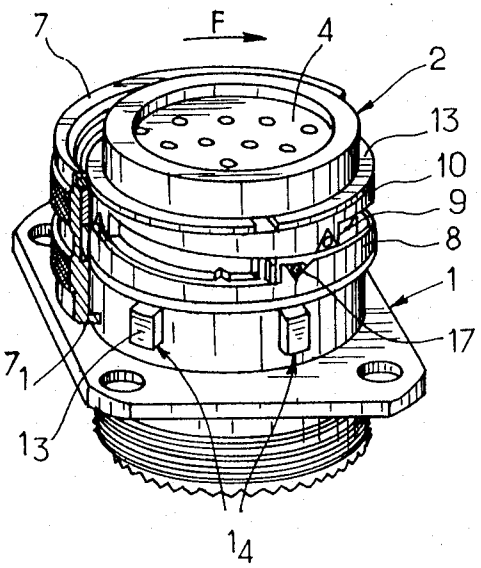
FIGS. 4 and 5 are partly cut-away perspective views corresponding to FIGS. 2 and 3 respectively.
Figure 5:
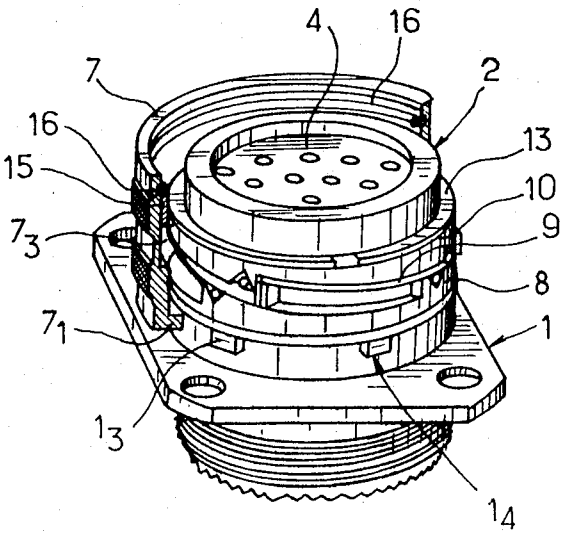

Consequently, plug 2 can be placed in the position ready for assembly on jack 1 (see FIGS. 2 and 4) simply by axially sliding barrel 7 along the jack via the complementary studs $1_3$ and grooves $7_2$; when collar $7_1$ has passed the bottom edge $1_4$ of studs $1_3$, barrel 7 can be rotated and thus held by the top edge of collar $7_1$ co-operating with the bottom edge of studs $1_3$.

At this stage of assembly, grooves $2_1$ begin to engage studs $1_3$, thus non-rotatably securing the plug relative to the jack and placing each pin opposite its corresponding socket.

The lock has three rings 8, 9, 10 which comprise a middle ring 9 coaxially placed between two outer rings 8 and 10.

The facing surfaces of each ring have identically shaped cam surfaces $8_1$, $9_1$, $9_2$ and $10_1$. In the example shown, each ring has three cam surfaces having identical lengths and gradients.

The internal side surfaces of rings 8, 9 and 10 have grooves $8_2$, $9_3$ and $10_2$ respectively, which correspond in size and position to ribs 11 on the outer wall of plug 2.

Each rib 11 is in two parts $11_1$, $11_2$ separated by a space having a height substantially equal to the height of the intermediate ring 9, so that the grooves $10_2$ and $8_2$ of the outer rings 10 and 8 engage rib parts $11_1$ and $11_2$ respectively whereas middle ring 9 between parts $11_1$ and $11_2$ of ribs 11 can rotate relative to plug 2, since grooves $9_3$ are designed only for securing ring 9.

At its base, plug 2 has an outer collar $2_2$ which engages the circular lower end of ring 8 via a split annular undulate spring 12. Rings 8, 9 and 10 are secured around plug 2 by aligning slots $8_2$, $9_3$, $10_2$ with the ribs 11 of the plug. The stack is held on the plug by a split ring 13 received in a groove $2_3$ in plug 2.

A split annular undulate spring 14 is disposed between the retaining ring 13 and the circular top end of ring 10. Preferably, the undulations of spring 14 and on spring 12 vary in amplitude for a single spring, thus obtaining aperiodic springs which co-operate to resist the vibration of the connector.

The outer wall of ring 9 has ribs $9_4$, which are formed in the connecting areas between the successive cam surfaces $9_1$ and $9_2$.

Ribs $9_4$ correspond in position to grooves $7_3$ formed on the inner side wall of barrel 7.

The bottoms of grooves $7_3$ are at a distance from the lower end of barrel 7 having the inner collar $7_1$ and the top ends of grooves $7_3$ are bounded by an inner shoulder $7_4$ which receives a circular cross-member 15 which is held in position by a split ring 16 disposed in an internal groove $7_5$ in the inner wall of barrel 7.

The construction is such that the height of grooves $7_3$ between their lower ends and cross-member 15 is slightly greater than the height of ring 9, i.e. greater than the height of ribs $9_4$.

This feature, therefore, gives slight axial clearance to the intermediate ring.

Figure 2:
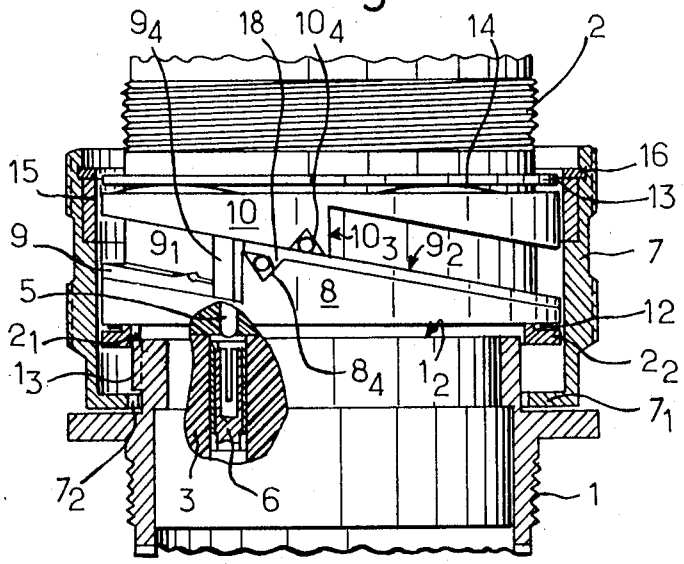
FIGS. 2 and 3 are cross-sectional views, with parts broken away, of the connector in FIG. 1, shown in the position ready for assembly (FIG. 2) and the locked position (FIG. 3)
Figure 3:
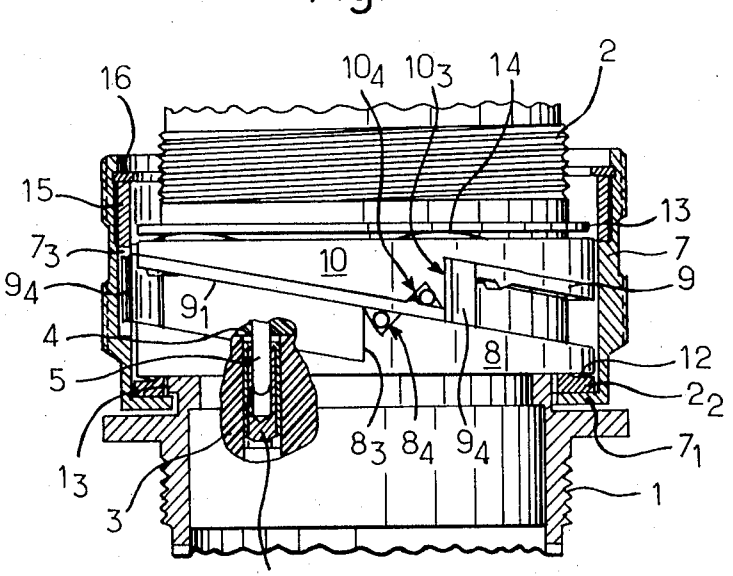

In addition, grooves $8_2$ of ring 8 and grooves $10_2$ of ring 10, which correspond in shape and position to ribs 11, are offset one from another relative to their respective cam surfaces $8_1$, $10_1$ so that when a stack is formed on ribs 11, the abutments $8_3$, $10_3$ of surfaces $8_1$, $10_1$ of rings 8, 10 are offset one from another (see FIGS. 2 and 3). This feature prevents barrel 7 from rotating more than e.g. 90° relative to plug 2, since middle ring 9 cannot rotate more than 90° since the abutments of surfaces $9_1$, $9_2$ bear against abutments $8_3$, $10_3$ at the ends of surfaces $8_1$ and $10_1$.

In order to continue the connecting operation beyond the pre-assembly position shown in FIG. 2, rotation of barrel 7 is required in the direction of arrow F (FIG. 4), thus rotating the middle ring 9, which is secured in rotation to barrel 7 by ribs $9_4$ and grooves $7_3$.

During the rotation, the bottom surfaces $9_1$ of middle ring 9 bear on the surfaces $8_1$ of ring 8 and thus axially move plug 2, since outer rings 8 and 10 are prevented by grooves $8_2$, $10_2$ and ribs $11_2$, $11_1$ from rotating relative to plug 2, whereas plug 2 is prevented by studs and grooves $1_3$, $2_1$ from rotating relative to socket 1.

Barrel 7 continues to rotate until members 5, 6 have fitted completely into one another and inserts 3, 4 are pressing against one another, in which position the ends of surfaces $9_1$ abut the flange $8_3$ of surfaces $8_1$.

The connector is thus fitted together. It can be disconnected simply by rotating barrel 7 in the opposite direction to arrow F, thus axially moving plug 2 from jack 1 by co-operation of surfaces $9_2$ with surfaces $10_1$.

At the end of the rotation, barrel 7 and plug 2 can be completely separated from jack 1 by axially moving grooves $7_2$ on studs $1_3$.

In order to facilitate rotation of barrel 7 relative to plug 2, surfaces $8_1$ and $10_1$ each have at least one slot $8_4$, $10_4$, each partially receiving a freely-rotating roller or ball 17 (a roller in the illustrated example). During rotation of middle ring 9, therefore, surfaces $9_1$, $9_2$ bear against surfaces $8_1$, $10_1$ via the rollers.

The connector also has detent means for locking plug 2 in position relative to barrel 7 when the connector is in either the disconnected or the connected position. The detent means comprise a catch 18, preferably of triangular section, formed near the bottom ends of surfaces $9_1$ and $9_2$.

When barrel 7 rotates its end position, the detent catches are adapted to be received in the slots $8_4$, $10_4$ of rings 8 and 10, which already hold rollers 17.

Thus, in order to rotate barrel 7 into the connected or disconnected position of the connector, the user has to overcome the resistance of springs 12 and 14 in order to move catches 18 out of slots $8_4$ or $10_4$.

This construction ensures that the connector is reliably locked in the connected position whereas when in the disconnected position the plug 2 can be angularly positioned relative to barrel 7 so that grooves $2_1$ are disposed in line with grooves $7_2$ to facilitate the connecting operation.

If required, middle ring 9 can have a number of regularly-spaced catches 18 (see FIG. 6) on one or both of surfaces $9_1$ and $9_2$, so that when barrel 7 rotates in order to connect or disconnect the connector, there are a series of clicks with an associated increase in resistance to the rotation of barrel 7.

Figure 7:
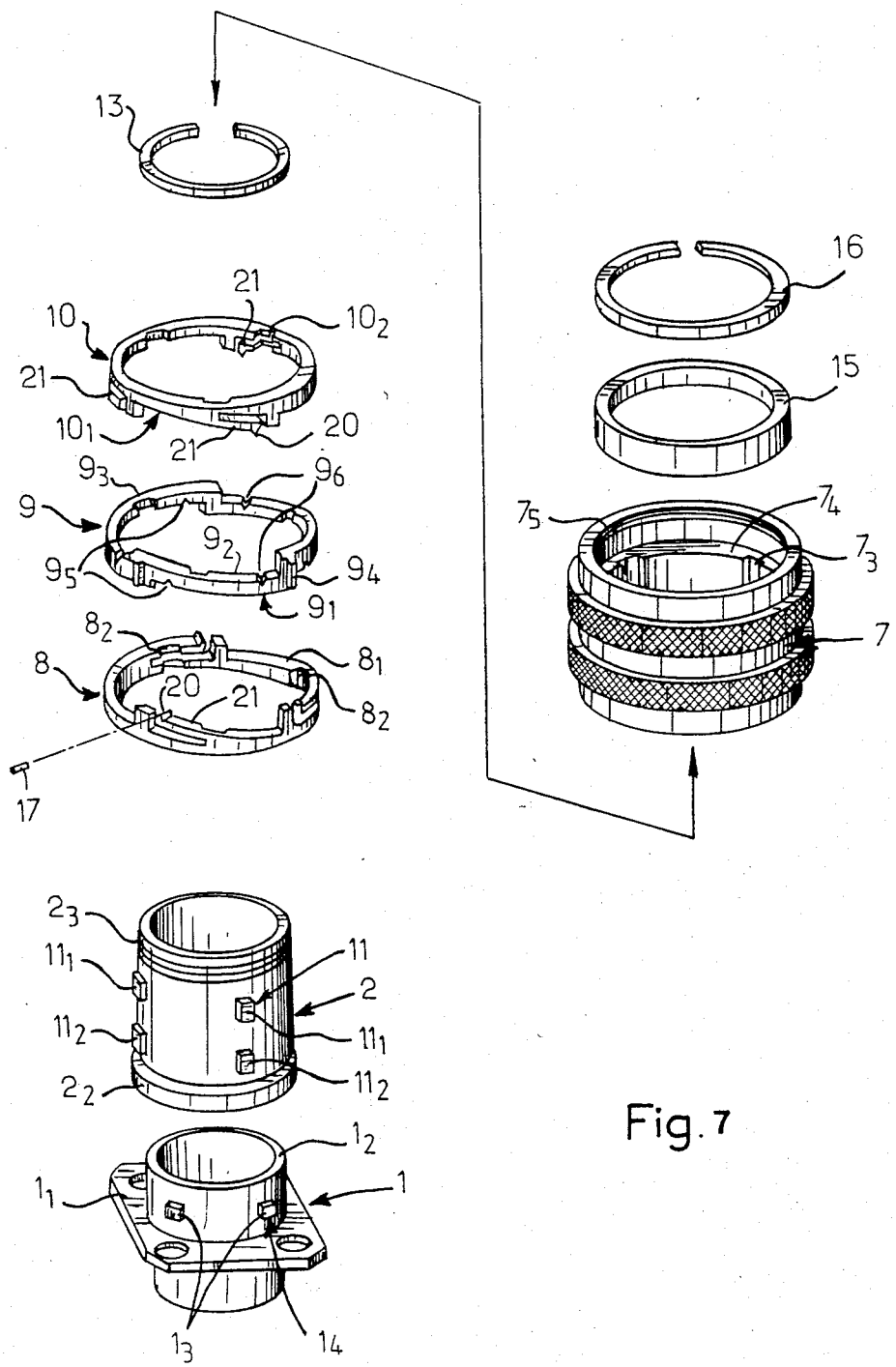
FIG. 7 is an exploded view of an embodiment of the connector according to the invention.
Figure 8:
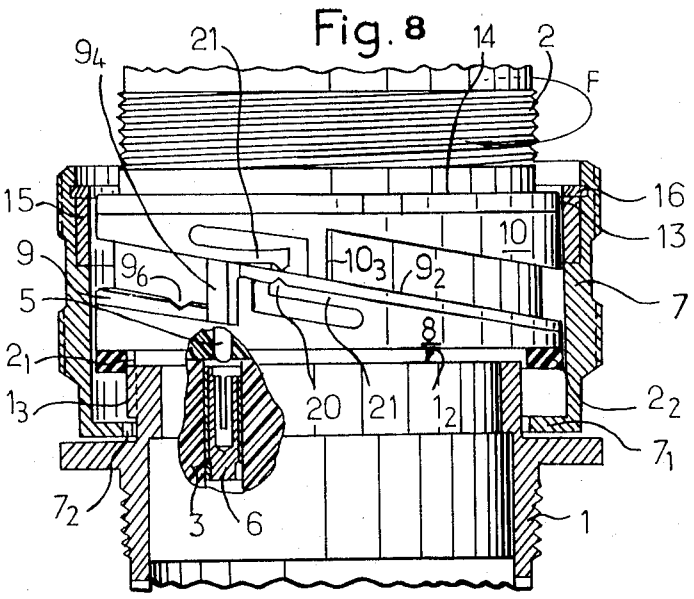
FIGS. 8 and 9 are partly cut-away views in axial section of the connector in FIG. 1, shown in the position ready for assembly (FIG. 8) and in the locked position (FIG. 9)
Figure 9:
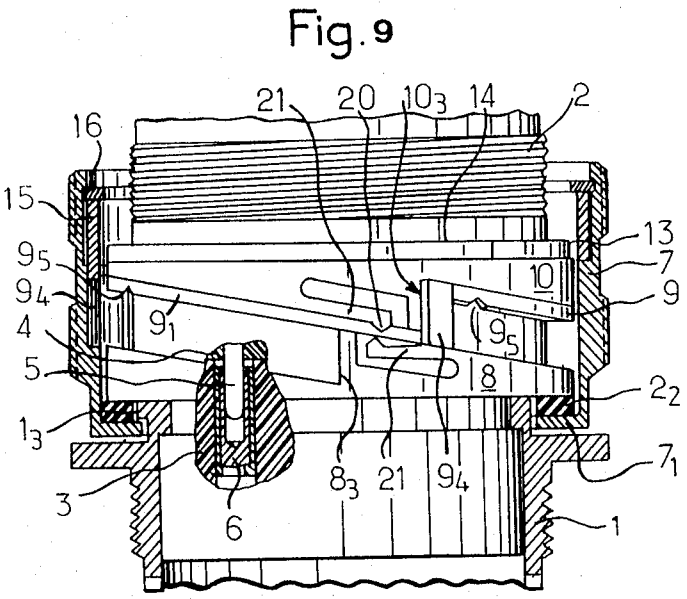

In the embodiment in FIGS. 7, 8 and 9, springs 12, 14 have been eliminated and the stack of rings, 8, 9 and 10 are held on the plug by a split ring 13 received in groove $2_3$ in plug 2, the distance between ring 13 and collar $2_2$ being equal to the constant height of the stack of rings 8, 9 and 10, which are thus axially positioned relative to the plug.

In the same construction, the height of grooves $7_3$ between their bottom ends and cross-member 15 corresponds to the height of ribs $9_4$ in middle ring 9. The middle ring is thus also held axially and in rotation on barrel 7.

In the embodiment in FIGS. 7, 8 and 9, detent means are also provided for locking plug 2 in position relative to barrel 7 when the connector is either in the disconnected or the connected position.

Of course, if it is thought sufficient, the detent means can provide for locking only in the disconnected or in the connected position.

The detent means comprise a catch 20, preferably of triangular section, formed near the top ends of surfaces $8_1$, $10_1$ of rings 8 and 10. Catches 20 are formed on the rings at the ends of resilient tongues 21 cut from the material forming rings 8 and 10.

Catches 20 are adapted, when barrel 7 rotates into its end positions, to be received in notches $9_5$, $9_6$ formed on the bottom and top surfaces respectively of ring 9 near the base of surfaces $9_1$ and $9_2$ respectively. Thus, in order to rotate barrel 7 towards the connected position (FIG. 2) or the position ready for connection (FIG. 8) the user must overcome the resistance of tongues 21 in order to bring catches 20 out of notches $9_5$ or $9_6$.

In the example shown, notches $9_5$, $9_6$ are formed only at the base of surfaces $9_1$ and $9_2$. Thus, in the position ready for connection (see FIG. 8), catches 20 of ring 8 are received in notches $9_5$ of ring 9 whereas catches 20 of ring 10 are resiliently pushed by surfaces $9_2$ as a result of the resilient deformation of tongues 21.

In the connected position, on the other hand (see FIG. 9), catches 20 of ring 10 are received in notches $9_6$ whereas catches 20 of ring 8 are pushed by surfaces $9_1$ owing to the resilient deformation of tongues 21 of ring 8.

Alternatively a number of notches $9_5$, $9_6$ can be formed along surfaces $9_1$ and $9_2$ if a number of clicks with an associated increase in the resistance to the rotation of barrel 7 are required when the connector is connected or disconnected.

Figure 10:
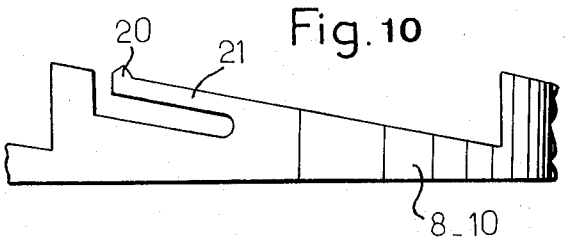
FIGS. 10 and 11 are enlarged views of portions of two embodiments of the outer rings of the connector.

In the example previously described with reference to FIGS. 7, 8 and 9, the resilient tongues 21 comprising catches 20 are integral parts of rings 8 and 10 and are obtained by machining the rings (FIG. 10).

However in another embodiment (see FIG. 11) tongues 22 and catches 23 can be independent components mechanically secured to rings 8 and 10.

Figure 11:
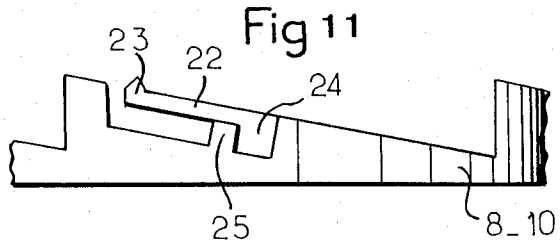

In the embodiment in FIG. 11, for example, tongues 22 have a shoulder 24 which is laterally force-fitted into a correspondingly-shaped orifice in ring 8 or 10. In that case, rings 8 and 10 preferably have an abutment 25 which bears against the base of tongues 22 in order to hold them correctly in position and to facilitate the elastic deformation of the tongues along their entire length.

Figure 6:
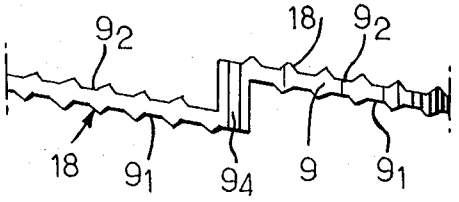
FIG. 6 is a partial side view of another embodiment of the intermediate ring.

In the example shown in FIGS. 6, 7 and 8, tongues formed with catches are also provided on the two end rings, and are thus identical except for the angular offset of grooves $8_2$ and $10_2$. The same result, however, can be obtained by providing a tongue and catch on at least one cam surface of one of the outer rings, in which case the middle ring will have two notches at the ends of the cam surface, disposed opposite the surface comprising the tongue and catch.

In a similar embodiment, the tongue or tongues and catches are formed on the middle ring 9, notches being formed on one or both outer rings 8 and 10.

Preferably the resonant frequencies of the tongues formed with raised portions will be different from one another, to prevent the tongues from simultaneously vibrating at a given frequency. This can be done e.g. by making the tongues of different lengths.

In the embodiments of FIGS. 1–5 and 7–9, rings 8, 9 and 10 are subjected only to frictional forces and can be made of hard metal, thus obtaining a reliable connector without appreciably increasing its weight, in view of the small volume of the components. This greatly increases the resistance to wear of the mechanical components used for insertion and locking.

In this construction, jack 1, plug 2 and barrel 7 can for the same reasons be made of light metal.

The three rings 8, 9 and 10 can also be used to obtain a connector which can be quickly and flexibly fitted together or disconnected (e.g. in a quarter-turn), using the cam surfaces on rings 8, 9 and 10.

The dimensions of the connector are also reduced in the radial and axial directions, since the hard-metal rings 8, 9 and 10 are thin in the radial direction, whereas the thickness of the wall of barrel 7 and members 1 and 2 can be reduced since they are subjected only to frictional forces.

The size of the connector is also reduced in the axial direction, since the height of the stack of rings 8, 9, 10 is small and, in the fitted-together position, studs $1_3$ are received inside body 2 at the height of ring 8.

In the embodiments shown in the drawings, middle ring 9 is secured in rotation relative to barrel 7 whereas outer rings 8, 10 are secured in rotation relative to plug 2.

However, a "reverse" embodiment can be obtained giving identical results, if outer rings 8, 10 are arranged to rotate with barrel 7 and middle ring 9 is prevented from rotating relative to plug 2.

Likewise, the interlocking grooves and ribs in the illustrated embodiments can be reversed, each rib taking the place of a groove and vice-versa.

In the illustrated embodiments, rings 8, 9 and 10 are components separate from the barrel and plug. However, one ring can be an integral part of the barrel or plug to which it is non-rotatably secured, if this increases the ease of manufacture and operation is satisfactory.

I claim:

1. In an electrical connector of the type having (a) a first cylindrical member, (b) a second cylindrical member, one of the cylindrical members being a plug having a plurality of protruding pins, the other cylindrical member being a jack having a plurality of sockets for receiving the pins, (c) means for aligning the pins of the plug with the sockets of the jack, and (d) lock means for drawing the aligned plug and jack together and holding them locked together by rotation of a lock element, the improvement wherein the lock means comprise (i) a first outer ring having a cam surface, (ii) a second outer ring having a cam surface, (iii) a middle ring situated between the two outer rings, the middle ring having a cam surface facing the cam surface of the first outer ring and a cam surface facing the cam surface of the second outer ring, the cam surfaces being arranged upon relative rotation between the middle ring and the two outer rings to cause the middle ring and one of the outer rings to move apart and simultaneously cause the middle ring and the other outer ring to move closer together whereby the total height of the three rings remain substantially unchanged.

2. The improvement according to claim 1, wherein (1) the cam surface of each ring has a plurality of similar sloping segments disposed symmetrically about the ring, and (2) the sloping cam surfaces of two adjacent rings interfitting when the two rings are at minimum total height.

3. The improvement according to claim 3, wherein the cam surface of each ring has at least three similar sloping segments.

4. The improvement according to claim 3, wherein at least one sloping segment of each ring terminates in an abutment, the abutments of adjacent rings cooperating to limit rotation of one ring relative to the other.

5. The improvement according to claim 4, wherein an abutment of one of the outer rings cooperates with an abutment of the middle ring to limit relative rotation in one direction and an abutment of the other outer ring cooperates with an abutment of the middle ring to limit relative rotation in the other direction.

6. The improvement according to claim 1, wherein the lock means further includes (iv) a barrel surrounding and secured to the middle ring for rotation therewith.

7. The improvement according to claim 1, wherein the lock means further includes, (iv) a barrel surrounding the three rings, and (v) means for causing rotation of the middle ring relative to the two outer rings upon rotation of the barrel.

8. The improvement according to claim 7, further including means holding the two outer rings in fixed alignment relative to one another.

9. The improvement according to claim 8, wherein the lock means further includes (vi) resilient means disposed to compress the three rings.

10. The improvement according to claim 1, wherein the lock means further includes (iv) detent means on the middle ring and on at least one of the outer rings for maintaining the rings in fixed relationship.

11. The improvement according to claim 10, wherein the detent means cooperate, adjacent the limit of rotation of the middle ring in at least one direction relative to the outer rings, to hold the rings in a fixed relationship.

12. The improvement according to claim 10 wherein the detent means cooperate to provide a plurality of click stops as the middle ring is rotated relative to the outer rings.

13. The improvement according to claim 10, wherein the detent means comprise (1) a resilient tongue carried by one of the rings, the tongue having a catch adjacent its tip, and (2) a recess formed in another of the rings for receiving the tongue's catch.

14. The improvement according to claim 13 wherein (A) the resilient tongue has a shoulder adjacent the end remote from the catch, and (B) the ring carrying the tongue has an aperture in which the shoulder is received.

15. The improvement according to claim 1, further including retaining means for keeping the three rings mounted on the exterior of one of the electrical connector's cylindrical members, the retaining means permitting the middle ring to rotate relative to the outer rings, and the retaining means holding the two outer rings in fixed alignment with respect to one another.

16. The improvement according to claim 15, wherein the lock means further includes (iv) resilient means disposed to compress the three rings, the resilient means being captured on said one of the cylindrical members by the retaining means.

17. The improvement according to claim 15, wherein the retaining means comprise (1) a collar adjacent one end of the cylindrical member on which the rings are mounted, (2) a groove in that cylindrical member spaced from the collar by a distance at least as great as the total height of the three rings, and (3) a split ring adapted to be received in the groove, the split ring providing a second collar, the three rings being captured between the two collars.

18. The improvement according to claim 15, wherein the retaining means holding the two outer rings in fixed alignment with respect to one another comprise spline elements and cooperating groove elements, the cylindrical member on which the rings are mounted having one kind of those cooperating elements and the rings having the other kind of those cooperating elements.

19. The improvement according to claim 18, wherein the lock means further includes, (iv) a barrel surrounding the three rings, and (v) means for causing rotation of the middle ring relative to the two outer rings upon rotation of the barrel.

20. The improvement according to claim 18 wherein the lock means further includes (iv) a barrel surrounding and secured to the middle ring for rotation therewith.

21. The improvement according to claim 15, wherein the lock means further includes (v) a barrel surrounding the three rings, rotation of the barrel causing relative rotation between the middle ring and the two outer rings, and (vi) means on the barrel for engaging cooperating means on the other one of the cylindrical members for keeping the plug in engagement with the jack upon rotation of the barrel.

* * * * *